US011745036B2

(12) United States Patent
Sorotskyi

(10) Patent No.: US 11,745,036 B2
(45) Date of Patent: Sep. 5, 2023

(54) FIRE PROTECTION SYSTEM

(71) Applicant: Carrier Corporation, Palm Beach Gardens, FL (US)

(72) Inventor: Andrii Sorotskyi, Gdansk (PL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 348 days.

(21) Appl. No.: 17/111,252

(22) Filed: Dec. 3, 2020

(65) Prior Publication Data

US 2021/0299502 A1 Sep. 30, 2021

(30) Foreign Application Priority Data

Mar. 25, 2020 (EP) ..... 20275065

(51) Int. Cl.

| | |
|---|---|
| ***G08B 17/06*** | (2006.01) |
| ***G08B 25/00*** | (2006.01) |
| ***G08B 29/04*** | (2006.01) |
| ***G08B 29/06*** | (2006.01) |
| ***A62C 37/50*** | (2006.01) |

(52) U.S. Cl.

CPC ..... *A62C 37/50* (2013.01); *G08B 17/06* (2013.01); *G08B 25/007* (2013.01); *G08B 29/04* (2013.01); *G08B 29/043* (2013.01); *G08B 29/06* (2013.01)

(58) Field of Classification Search

CPC ..... G08B 17/06; G08B 25/007; G08B 29/04; G08B 29/043; G08B 29/06

See application file for complete search history.

(56) References Cited

U.S. PATENT DOCUMENTS

| | | | | |
|---|---|---|---|---|
| 6,954,701 | B2 | 10/2005 | Wolfe | |
| 7,113,090 | B1 | 9/2006 | Saylor et al. | |
| 8,073,931 | B2 | 12/2011 | Dawes et al. | |
| 8,677,505 | B2 | 3/2014 | Redlich et al. | |
| 8,934,754 | B2 | 1/2015 | Billau et al. | |
| 9,191,632 | B2 | 11/2015 | Billau et al. | |
| 9,198,203 | B2 * | 11/2015 | Shaffer | H04W 76/50 |
| 9,449,491 | B2 | 9/2016 | Sager et al. | |
| 9,633,547 | B2 | 4/2017 | Farrand et al. | |
| 10,127,801 | B2 | 11/2018 | Raji et al. | |
| 10,154,321 | B2 | 12/2018 | Berchtold et al. | |
| 10,297,142 | B2 * | 5/2019 | Lindoff | H04W 76/50 |
| 10,405,269 | B2 * | 9/2019 | Sachs | H04W 48/18 |

(Continued)

FOREIGN PATENT DOCUMENTS

| | | |
|---|---|---|
| CN | 106445739 A | 2/2017 |
| CN | 107644502 A | 1/2018 |

(Continued)

OTHER PUBLICATIONS

European Search Report for European Application No. 20275065.9; dated Sep. 30, 2020 (pp. 1-9).

*Primary Examiner* — Hoi C Lau
(74) *Attorney, Agent, or Firm* — Cantor Colburn LLP

(57) ABSTRACT

A fire protection system 100 includes one or more fire protection components 12 that can each generate messages indicating an event. Messages are determined to be indicative of either critical or non-critical events. Data associated with messages indicative of critical events is stored in a first collection of event data 32, while data associated with messages indicative of non-critical events is stored in a second different collection of event data 32.

12 Claims, 2 Drawing Sheets

(56) References Cited

U.S. PATENT DOCUMENTS

| | | | | |
|---|---|---|---|---|
| 10,498,585 | B2 | 12/2019 | Chakrobartty et al. | |
| 10,530,839 | B2 | 1/2020 | Kitchen et al. | |
| 2004/0150519 | A1 | 8/2004 | Husain et al. | |
| 2007/0174692 | A1* | 7/2007 | Nagasawa | G06F 11/1451 714/13 |
| 2007/0222559 | A1* | 9/2007 | Nickens | G08B 25/016 340/7.1 |
| 2012/0117268 | A1* | 5/2012 | Shaffer | H04W 4/38 709/238 |
| 2014/0009280 | A1 | 1/2014 | Takahash et al. | |
| 2014/0266684 | A1* | 9/2014 | Poder | G08B 25/001 340/521 |
| 2017/0048792 | A1* | 2/2017 | Sachs | H04W 72/542 |
| 2017/0060694 | A1 | 3/2017 | Makhov et al. | |
| 2017/0060964 | A1* | 3/2017 | Kenthapadi | G06F 16/248 |
| 2018/0025622 | A1* | 1/2018 | Lindoff | H04W 24/02 340/506 |
| 2019/0370179 | A1* | 12/2019 | Xiao | G06F 9/4881 |
| 2021/0299502 | A1* | 9/2021 | Sorotskyi | G08B 25/007 |

FOREIGN PATENT DOCUMENTS

| | | | | |
|---|---|---|---|---|
| EP | 0463874 | A2 | 1/1992 | |
| EP | 3575965 | A1 * | 12/2019 | G05B 19/0423 |
| EP | 3575965 | A1 | 12/2019 | |
| GB | 2290644 | A | 1/1996 | |
| WO | 2011038409 | A1 | 3/2011 | |

* cited by examiner

FIRE PROTECTION SYSTEM

CROSS-REFERENCE TO RELATED APPLICATIONS

This application claims priority to European Patent Application No. 20275065.9 filed Mar. 25, 2020, the contents of which are incorporated by reference herein in their entirety.

BACKGROUND

The present disclosure relates to a method of operating a fire protection system, and a fire protection system.

Fire protection systems typically comprise a fire control panel and one or more other fire protection components, such as fire detectors (such as smoke and heat sensors), manual call points, fire alarms, and fire suppression systems (such as sprinklers, fire barriers, smoke extractors, etc.). The components of the fire protection system are typically electrically connected in a loop configuration, with the connecting wiring starting and finishing at the fire control panel.

In these systems, each component may be able to generate messages that each indicate an event, such as an alarm, fault, warning, reply to a command, and the like.

The Applicant believes that there remains scope for improvements to fire protection systems.

SUMMARY

The present invention provides a method of operating a fire protection system, the fire protection system comprising one or more fire protection components, the method comprising:

a fire protection component of the one or more fire protection components of the fire protection system generating a message indicating an event associated with the fire protection system;

determining whether the message is indicative of a critical event or a non-critical event; and when it is determined that the message is indicative of a critical event, storing data associated with the message in a first collection of event data; and when it is determined that the message is indicative of a non-critical event, storing data associated with the message in a second different collection of event data.

Various embodiments relate to the efficient handling of fire protection system message data. The inventor has recognized that some messages generated by a fire protection system may have a greater degree of importance than other messages generated by the fire protection system, and that the likelihood and desirability of this more important message data being retrieved, e.g. for review, may be greater than for less important message data. For example, a message indicating that a fire alarm has been triggered may typically be of greater importance, and more likely to be later reviewed, than a message that indicates that a fire protection component of the fire protection system has entered a quiescent state.

In the present invention, fire protection system messages are determined to be either of "critical" importance or "non-critical", and data associated with critical messages is then stored separately from data associated with non-critical messages. By classifying and storing critical and non-critical message data separately in this manner, the overall efficiency with which message data can be retrieved can be improved, e.g. as compared to conventional arrangements in which all system message data is stored together in the same collection.

For example, the present invention allows only the more important, critical message data to be retrieved without needing e.g. to read and process all message data in order to determine which message data is critical (or not). Moreover, retrieving only critical message data can reduce the overall amount of data retrieved. This then means that when message data is stored remotely and accessed e.g. over a network, a reduction in bandwidth usage can be achieved.

Furthermore, the separation of critical and non-critical message data can allow back-up strategies to focus on critical message data. For example, critical message data may be backed up separately from non-critical message data. Non-critical message data may be backed-up less frequently than critical message data, or not at all. This can accordingly save disk space and processing associated with backing up fire protection system message data.

It will be appreciated, therefore, that the present disclosure provides an improved fire protection system.

A (the) fire protection component of the fire protection system may be a fire control panel, a fire detector, a smoke detector, a heat detector, a manual call point, a fire alarm, a fire suppression component, a sprinkler, a fire barrier, a smoke extractor, or another fire protection component.

A (the) event may be an Alarm, PreAlarm, PreWarning, Fault, Quiescent, Disabled, or Offline event, or another type of event. Alarm, PreAlarm, or PreWarning events may each be critical events. Fault, Quiescent, Disabled, or Offline events may each be non-critical events.

Determining whether the message is indicative of a critical event or a non-critical event may comprise: determining a type of the message; and determining whether the message is indicative of a critical event or a non-critical event using the determined message type.

A (the) message may be a message indicative of an Alarm, PreAlarm, PreWarning, Fault, Quiescent, Disabled, or Offline event, or a message indicative of another type of event.

Determining the type of the message may comprise determining whether the message is indicative of an Alarm, PreAlarm, PreWarning, Fault, Quiescent, Disabled, or Offline event. Determining whether the message is indicative of a critical event or a non-critical event using the determined message type may comprise: determining that the message is indicative of a critical event when it is determined that the message is indicative of an Alarm, PreAlarm, or PreWarning event; and determining that the message is indicative of a non-critical event when it is determined that the message is indicative of a Fault, Quiescent, Disabled, or Offline event.

The data associated with a message that is stored may comprise any one or more or each of: an indication of the message type, payload data of the message, and/or a timestamp.

The method may further comprise: when it is determined that the message is indicative of a critical event, storing a reference to the data associated with the message in the second different collection of event data. The reference may comprise a pointer, such as a pointer to the (data associated with the event stored in the) first collection of event data.

The fire protection system may further comprise storage for storing data associated with the fire protection system. The storage may comprise any suitable memory. The data associated with a (the) message generated by a (the) fire protection component of the fire protection system may be stored in the storage.

The first and second collections of event data can each be any suitable collection of event data, and may each be stored in the storage. The first and second collections of event data should be separately addressable collections of data (files), i.e. such that data in the first collection (file) can be accessed independently of (without needing to access) data in the first collection (file). For example, the storage may store a database, the first collection of event data may be a first table in the database, and the second different collection of event data may be a second different table in the database. Alternatively, the first collection of event data may be a first log file stored in the storage, and the second different collection of event data may be a second different log file stored in the storage.

The method may further comprise: determining whether the message or the data associated with the message indicates that the state of the fire protection system has changed; and when it is determined that the (message or the data associated with the message indicates that the) state of the fire protection system has changed, updating information indicating a current state of the fire protection system.

The information indicating the current state of the fire protection system may comprise information indicating a current state of each component of the fire protection system.

The information indicating the current state of the fire protection system may be stored in the storage, for example in a third log file.

The method may further comprise: making a copy of the information indicating the current state of the fire protection system at a first time, and then making a copy of the information indicating the current state of the fire protection system at a second different (later) time. The copy of the information indicating the current state of the fire protection system at the first time, and the copy of the information indicating the current state of the fire protection system at the second different time may be different (e.g. due to the updating of the information indicating the current state of the fire protection system between the first time and the second time).

The method may further comprise: periodically making a new copy of the information indicating the current state the fire protection system. Each new copy of the information indicating the current state of the fire protection system may be different to any other copy (e.g. due to the updating of the information indicating the current state of the fire protection system).

The period with which each new copy of the information indicating the current state of the fire protection system is made can by any suitable period, such as for example of the order of one or more hour(s), or one or more day(s).

Each copy of the information indicating the current state of the fire protection system may be stored in the storage, for example in a fourth log file.

The method may further comprise: reading the most recently stored copy of the information indicating the current state of the fire protection system and any (optionally critical) message data stored since the most recently stored copy of the information indicating the current state of the fire protection system was made; and using the read information and message data to determine a current state of the fire protection system.

The fire protection system may optionally further comprise a server. The method may comprise the server: receiving the message; determining whether the message is indicative of a critical event or a non-critical event; and when it is determined that the message is indicative of a critical event, storing data associated with the message in the first collection of event data; and when it is determined that the message is indicative of a non-critical event, storing data associated with the message in the second different collection of event data.

The method may further comprise (for example, the server) receiving a request to retrieve stored data associated with one or more messages (optionally from a client); (the server) determining whether all of the requested data is associated with messages indicative of critical events; and when it is determined that all of the requested data is associated with messages indicative of critical events, (the server) reading the requested data from the first collection of event data.

When it is determined that less than all of the requested data is associated with messages indicative of critical events (when it is determined that some or all of the requested data is associated with messages indicative of non-critical events), then the method may comprise (the server) reading the requested data from the second collection of event data, and optionally from both the first collection of event data and the second collection of event data. For example, the data associated with messages indicative of non-critical events may be read from the second different collection of event data, and any data associated with messages indicative of critical events may be read from the first collection of event data (optionally using a reference(s) stored in the second different collection of event data).

The method may further comprise (the server) sending the read data to the requester (client).

The method may further comprise retaining data associated with messages indicative of critical events in preference to data associated with messages indicative of non-critical events. For example, non-critical message data may be overwritten by critical message data, e.g. if the storage becomes full.

The method may further comprise backing up data associated with messages indicative of critical events separately from data associated with messages indicative of non-critical events. The method may comprise backing up the first collection of event data separately from the second collection of event data.

The method may further comprise backing up data associated with messages indicative of critical events in preference to data associated with messages indicative of non-critical events. For example, non-critical message data may be backed up less frequently than critical message data, or only critical message data may be backed up (and non-critical message data may be not backed up).

The present invention also provides a fire protection system comprising:

one or more fire protection components, wherein one or more of the one or more fire protection components are configured to generate messages, each message indicating an event associated with the fire protection system;

storage for storing data associated with the fire protection system; and processing circuitry (a processor) configured to:

determine whether a message generated by a fire protection component of the one or more fire protection components is indicative of a critical event or a non-critical event; and when it is determined that the message is indicative of a critical event, store data associated with the message in a first collection of event data in the storage;

and when it is determined that the message is indicative of a non-critical event, store data associated with the message in a second different collection of event data in the storage.

The processing circuitry (processor) may be further configured to perform any one or more of the method steps described above, as appropriate.

The one or more fire protection components may comprise one or more fire control panels, each fire control panel being connected to a respective set of one or more other fire protection components.

A (the) set of one or more other fire protection components may comprise any one or more of: a fire detector, a smoke detector, a heat detector, a manual call point, a fire alarm, a fire suppression component, a sprinkler, a fire barrier, and a smoke extractor.

The processing circuitry (processor) may form part of a (the) fire control panel.

The system may optionally further comprise a server. The processing circuitry (processor) may form part of the server. The one or more fire control panels may each be configured to send messages generated by fire protection components to the server.

The server may be further configured to: receive a request to retrieve stored data associated with one or more messages (optionally from a client); determine whether all of the requested data is associated with messages that are indicative of critical events; and when it is determined that all of the requested data is associated with messages that are indicative of critical events, read the requested data from the first collection of event data.

The server may be further configured to: when it is determined that less than all of the requested data is associated with messages that are indicative of critical events (when it is determined that some or all of the requested data is associated with messages that are indicative of non-critical events), read requested data from the second collection of event data, and may be configured to read the requested data from both the first collection of event data and the second collection of event data. For example, the sever may be configured to read non-critical message data from the second different collection of event data, and to read any critical message data from the first collection of event data (optionally using a reference(s) stored in the second different collection of event data).

The server may be further configured to send read data to a (the) client.

The data associated with a message that is stored (and read) may comprise any one or more or each of: an indication of the message type, payload data of the message, and/or a time-stamp.

The first and second collections of event data can each be any suitable collection of event data, and may each be stored in the storage. For example, the storage may store a database, the first collection of event data may be a first table in the database, and the second different collection of event data may be a second different table in the database. Alternatively, the first collection of event data may be a first log file stored in the storage, and the second different collection of event data may be a second different log file stored in the storage.

DRAWING DESCRIPTION

Certain preferred embodiments of the present invention will now be described, by way of example only, with reference to the following drawing, in which.

DETAILED DESCRIPTION

Figure 1:
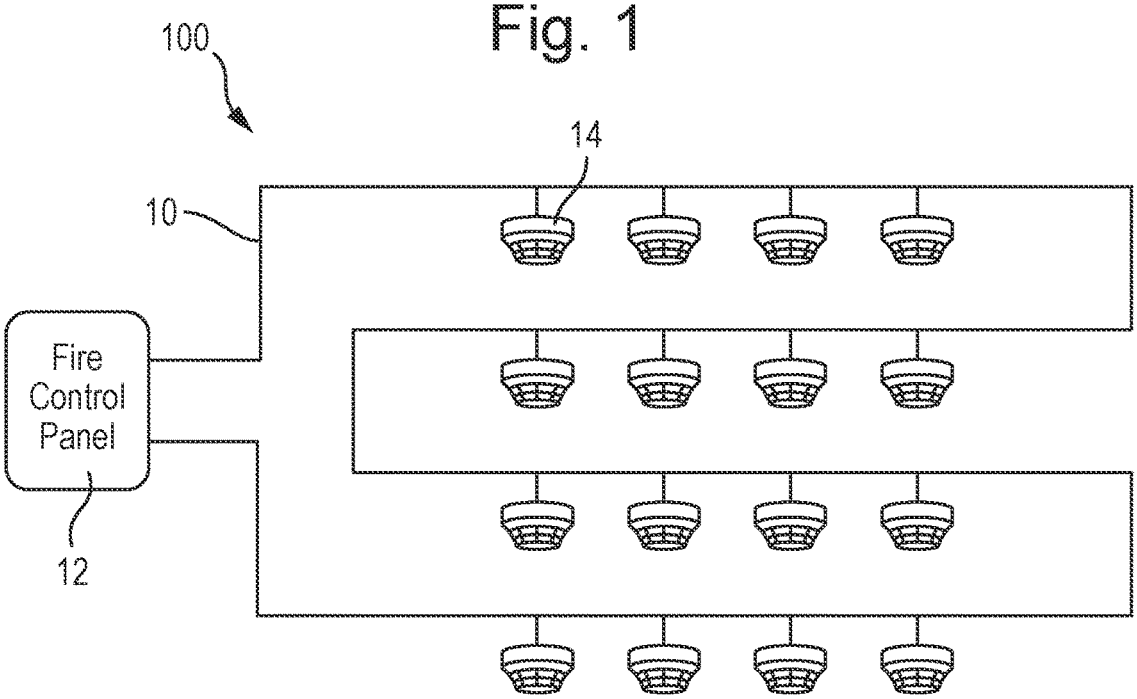
FIG. 1 shows schematically part of a fire protection system comprising a plurality of fire detectors.

FIG. 1 shows schematically part of a fire protection system 100 in accordance with various embodiments. As shown in FIG. 1, the fire protection system 100 may comprise a fire control panel 12 and a set of one or more other fire protection components 14 connected via wiring 10 to the fire control panel 12.

In the embodiment illustrated in FIG. 1, each of the components 14 is a fire detector, which in this example are illustrated as smoke sensors. However, more generally, the set of one or more other fire protection components may include one or more fire detectors (such as one or more smoke and/or heat sensors), one or more manual call points, one or more fire alarms, one or more fire suppression systems (such as one or more sprinklers, fire barriers, smoke extractors, etc.), and the like.

Moreover, FIG. 1 shows only one fire control panel 12 electrically connected to one set of other fire protection components 14. However, more generally, the fire protection system may comprise plural fire control panels, with each fire control panel being electrically connected to a respective set of one or more other fire protection components.

Thus, the fire protection system 100 may comprise one or more fire control panels 12, each fire control panel being electrically connected to a respective set of one or more other fire protection components 14, such as any one or more of a fire detector, a smoke detector, a heat detector, a manual call point, a fire alarm, a fire suppression component, a sprinkler, a fire barrier, a smoke extractor, and the like.

A set of one or more components 14 of the fire protection system 100 may be electrically connected via wiring 10, for example in a loop configuration, with the connecting wiring 10 being connected to (for example, starting and finishing at) a fire control panel 12. The fire protection system 100 may be configured such that each component 14 receives electrical power from the fire control panel 12 it is connected to via wiring 10.

The fire protection system 100 may be configured such that each component 14 is able to communicate with the fire control panel 12 it is connected to, for example via wiring 10. This communication may comprise each component 14 being able to generate messages each indicating an event associated with the component 14, and to send such generated messages to the fire control panel 12 it is connected to. Correspondingly, the fire control panel 12 may be able to receive messages from each fire protection component of the set one or more fire protection components 14 connected to it. The fire control panel 12 may also be able to generate messages each indicating an event associated with the fire control panel 12 itself.

A fire protection component may generate a message in response to the fire protection component receiving an enquiry from a fire control panel 12, or in response to the fire protection component detecting an event, for example. An event can be any suitable event, such as an Alarm, PreAlarm, PreWarning, Fault, Quiescent, Disabled, or Offline event, and the like.

A message generated by a fire protection component of the fire protection system 100 can contain any suitable and desired information, such as an indication of an event associated with the fire protection component, and a time-stamp indicating the time that the event occurred. A message can be any suitable and desired type of message, such as a message indicative of an Alarm, PreAlarm, PreWarning, Fault, Quiescent, Disabled, or Offline event, and the like.

An alarm event may be an event, for example from a fire detector, that indicates a fire incident. A PreAlarm or PreWarning event may be an event, for example from a detector, that indicates an incident that could lead to fire incident, such as a dangerous increase of the temperature or smoke concentration.

A Fault event may be an event, for example from the fire control panel, related to the incorrect performance of a specific component of the fire protection system, a group of components, or the entire fire protection system. A Quiescent event may be an event indicating a normal state (i.e. the component is working properly) of a component, for example which may be sent to the fire control panel. A Disabled event may be an event indicating that a component was disabled, for example by the fire protection system operator. An Offline event may be an event, for example from the fire control panel, indicating that the fire control panel cannot connect to a component.

Figure 2:
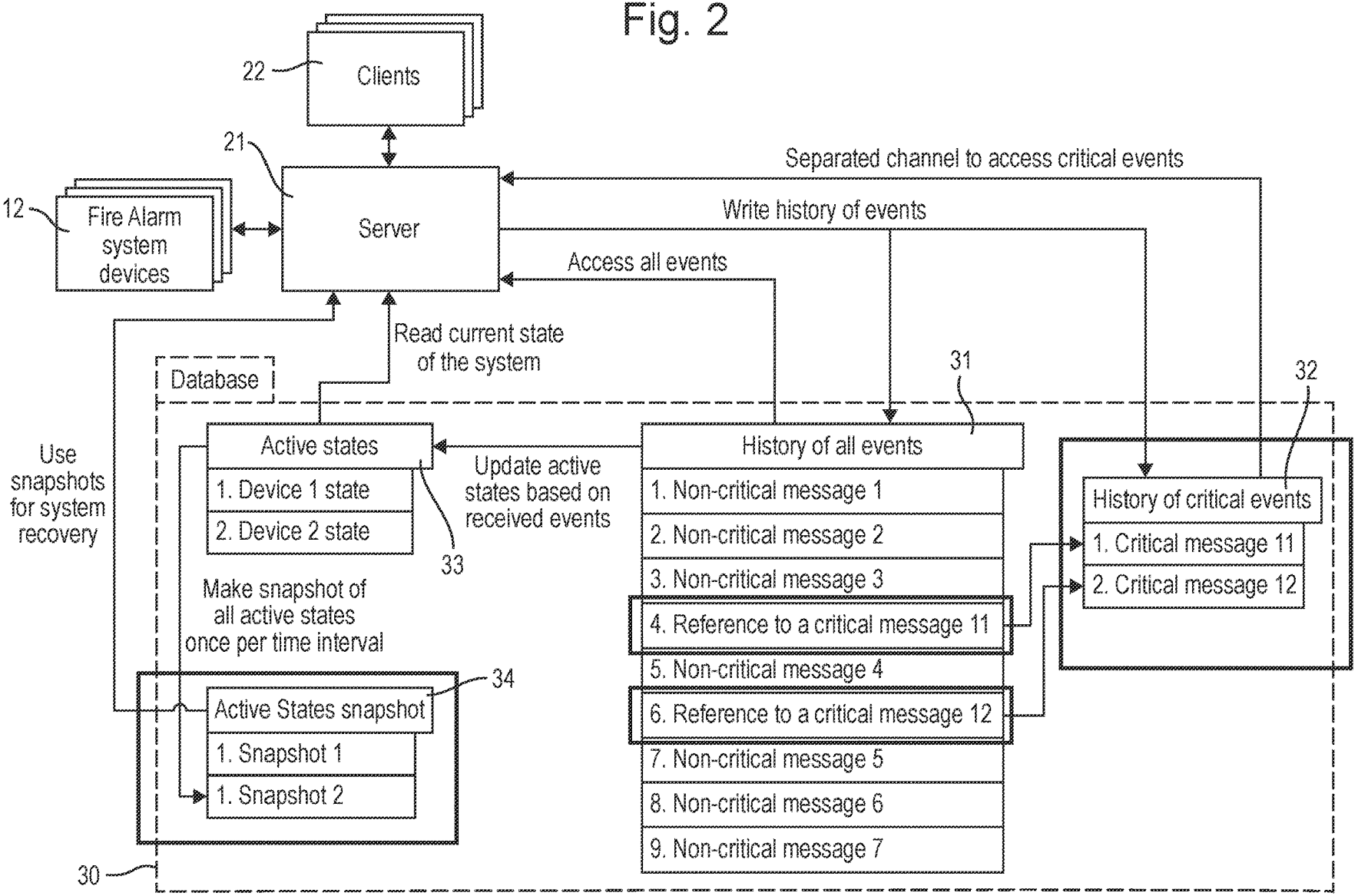
FIG. 2 is a schematic diagram of a fire protection system in accordance with various embodiments.

As shown in FIG. 2, in the present embodiment, the fire protection system 100 further comprises a server 21, and each fire control panel 12 of the fire protection system 100 can communicate with the server 21. In particular, each fire control panel 12 may transmit messages it generates and/or receives from fire protection components connected to it to the server 21. The server 21 may then operate to store messages it receives from each fire control panel 12 of the fire protection system 100 in a database 30 associated with the server 21.

However, the fire protection system 100 need not comprise a server 21, and for example, each fire control panel 12 may be configured to store messages in a database 30 associated with the fire control panel(s) 12 (and otherwise operate in the manner described further below).

The message data stored in the database 30 can then be accessed by each fire control panel 12, and/or by one or more other client devices 22, for example via the server 21 as desired. Each fire control panel 12 and/or client device 22 may accordingly be able to request data, optionally from the server 21, and the server 21 (or fire control panel 12) may, in response to such a request, retrieve data from the database 30 in accordance with the request, and send the retrieved data to the requester.

In the present embodiment, the server 21 may optionally be a remote, e.g. cloud-based, server, and the database 30 may be stored in remote, e.g. cloud-based, storage. Each fire control panel 12 may accordingly be able to transmit (encrypted) message data to the server 21 over a network (e.g. the internet). Correspondingly, a fire control panel 12 and/or other client device 22 of the fire protection system 100 may be able to query the server 21, and receive (encrypted) message data, over the network (e.g. the internet). This arrangement can facilitate particularly convenient access to fire protection system data.

In the present embodiment, when the server 21 receives a message from a fire control panel 12, the server 21 determines whether the message is indicative of a critical event or a non-critical event, i.e. determines whether the message is a critical message or a non-critical message. The server 21 then operates to store message data for critical and non-critical messages separately in the database 30 based on the determination. (Alternatively, this may be performed by a fire control panel 12.)

The message data that is stored may comprise any one or more or each of: an indication of the message type, payload data of the message, a time-stamp, and the like. The first and second collections of event data are separately addressable collections of data (files), i.e. such that data in the first collection (file) can be accessed independently of (without needing to access) data in the first collection (file).

As discussed above, by classifying and storing critical and non-critical message data separately, the efficiency with which the message data can be subsequently retrieved can be improved, e.g. as compared to storing all message data together. For example, critical data can be retrieved quickly and efficiently, without e.g. needing to read (and then discard) non-critical message data. Accordingly, storing critical and non-critical message data separately can allow faster access to critical message data, which may typically be accessed more frequently that non-critical message data. Moreover, the amount of data transmitted from the server 21 to a fire control panel 12 or client 22 over the network can be reduced. Accordingly, bandwidth requirements can be reduced.

The determination of whether a message is indicative of a critical or non-critical event (of whether a message is critical or non-critical) can be performed in any suitable and desired manner. In the present embodiment, the server 21 (or fire control panel 12) determines whether a message it has received is indicative of a critical or non-critical event based on the type of the message received. For example, when the server 21 (or fire control panel 12) receives an Alarm, PreAlarm, or PreWarning message, or the like, the server 21 (or fire control panel 12) may determine that the message is indicative of a critical event. When, however, the server 21 (or fire control panel 12) receives a Fault, Quiescent, Disabled, or Offline message, or the like, the server 21 may determine that the message is indicative of a non-critical event.

Once the server 21 (or fire control panel 12) has determined whether a message it has received is indicative of a critical or non-critical event, the server 21 (or fire control panel 12) operates to store data associated with the message in the database 30 in accordance with the determination.

To facilitate this, as shown in FIG. 2, in the present embodiment, the database 30 is arranged with a number of different tables (or files) for storing data associated with the fire protection system 100. In particular, the database 30 includes a "history of critical events" table (or file) 32 for storing critical message data, and a "history of all events" table (or file) 31 for storing non-critical message data.

Accordingly, when the server 21 (or fire control panel 12) determines that a message it has received is indicative of a non-critical event, the server 21 (or fire control panel 12) stores data associated with the message as a new record in the "history of all events" table 31 in the database 30. When, however, the server 21 (or fire control panel 12) determines that a message it has received is indicative of a critical event, the server 21 (or fire control panel 12) stores data associated with the message as a new record in the "history of critical events" table 32. Furthermore, in the case of a critical message, the server 21 may also include in the "history of all events" table 31, a new record that includes a reference to the data associated with the critical message stored in the "history of critical events" table 32.

This then means that the "history of critical events" table 32 includes only records storing message data for critical messages (received by the server 21) arranged in chronological order. The "history of all events" table 31, by contrast, may include a record for each (critical and non-critical) message (received by the server 21) arranged in chronological order. However, in the case of a non-critical message, the "history of all events" table 31 includes a record which stores message data in respect of the non-critical message; whereas in the case of a critical message, the "history of all events" table 31 does not store message data in respect of the critical message, but instead includes a record which includes a reference to the corresponding critical message data stored in the "history of critical events" table 32.

Including references to critical message data in the "history of all events" table 31, rather than e.g. storing critical message data in the "history of all events" table 31, means that the "history of all events" table 31 can preserve the chronology of all (critical and non-critical) events, but without duplicating stored message data. Accordingly, storage space requirements can be reduced.

Moreover, in this arrangement, when access to both critical and non-critical event data is required, e.g. by a fire control panel 12 or client 22, the server 21 (or fire control panel 12) can access the "history of all events" table 31, and then retrieve non-critical message data directly from the "history of all events" table 31, and critical message data via a reference to the "history of critical events" table 32. When, however, access only to critical event data is required, the server 21 (or fire control panel 12) can access only the "history of critical events" table 32. As discussed above, this can improve the efficiency with which critical data is accessed.

The division of message data into critical and non-critical message data also enables critical and non-critical message data to be handled differently. For example, in an embodiment, when the storage storing the database 30 becomes full, non-critical message data is preferentially overwritten, rather than critical message data. This can then reduce or avoid the loss of critical message data.

Similarly, in an embodiment, critical message data is backed up separately from non-critical message data, e.g. using two tables (two files) in the manner described above. Non-critical message data may be backed up less frequently that critical message data, or not at all. This can save back up disk space, processing and bandwidth requirements, for example.

As shown in FIG. 2, in the present embodiment, the database 30 further comprises an "active states" table (or file) 33 for storing information indicating the current state of the fire protection system 100, which may include information indicating the current state of each of one or more fire protection components of the fire protection system 100. Accordingly, each record in the "active states" table 33 may indicate the current state of a fire protection component of the fire protection system 100.

When a new message is received (or when a record for a new message is created, e.g. in the "history of all events" table 31), it is determined whether that message indicates that the state of the fire protection system has changed, e.g. whether the state of a component of the fire protection system has changed. When it is determined that the state of a fire protection component has changed, then the record in the "active states" table 33 for that component is updated accordingly.

As shown in FIG. 2, the database 30 further comprises an "active states snapshots" table (or file) 34 for storing "snapshots" of the contents of the "active states" table 33. Accordingly, each record in the "active states snapshots" table 34 includes an indication (a "snapshot") of the state that (each of one or more fire protection components of) the fire protection system 100 was in at a particular point in time.

New snapshots of the contents of the "active states" table 33 can be created and added as new records in the "active states snapshots" table 34 at any desired times. For example, new "snapshots" may be periodically generated and added as new records to the "active states snapshots" table 34.

The time period with which "snapshots" are created can be any suitable period, such as of the order of one or more hours or one or more days, and may be user configurable. Thus, for example, for systems where changes in actives states are likely to occur more frequently (e.g. in systems comprising a relatively large number of fire protection components), a shorter time period may be selected than for systems where changes in active states are likely to occur less frequently (e.g. in systems comprising a smaller number of fire protection components).

In the present embodiment, the "snapshots" stored in the "active states snapshots" table 34 may be used to recover the state of the system 100, e.g. when the server 21 or fire control panel 12 starts up, e.g. after a reboot/failure. In particular, the state of each system component may be recovered (determined) by reading the most recent snapshot from the "active states snapshots" table 34, and reading data in the "history of all events" table 31 associated with any messages that were received since the most recent snapshot was generated, and processing that message data to determine if the state of any component(s) has changed since the most recent snapshot was generated.

Using the most recent "snapshot" in this manner means that the state of each system component can be recovered without e.g. needing to process the entire event data history in the "history of all events" table 31. Accordingly, processing and bandwidth requirements can be reduced, and start-up time can be shortened. Moreover, the system can be "rolled-back" to the last active snapshot, if desired.

Figure 3:
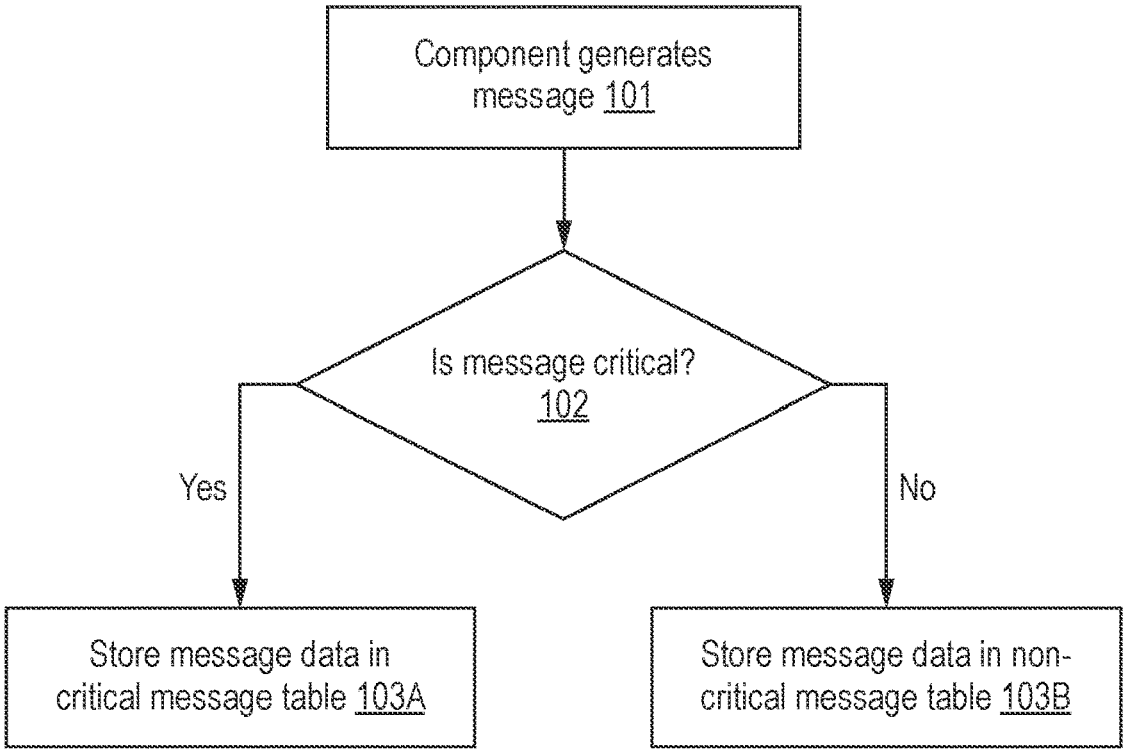
FIG. 3 is a flowchart illustrating a method in accordance with an embodiment of the present invention.

FIG. 3 is a flowchart showing a process according to an embodiment of the present invention. As shown in FIG. 3, at step 101 a message may be generated by a component of the fire protection system. At step 102, it may be determined whether or not the message is indicative of a critical event. If it is determined that the message is indicative of a critical event, then at step 103A, data associated with the message may be stored in a critical message data table in a database. If, however, it is determined that the message is not indicative of a critical event, then at step 103B, data associated with the message may be stored in a non-critical message data table in the database.

Although in the above described embodiments, the server 21 may be remote from a fire control panel 12, in other embodiments, the server 21 may be local to a fire control panel 12. For example, the server 21 may be hosted on a fire control panel 12 of the system, and the database 30 may be stored in storage of the fire control panel 12.

Although in the above described embodiments, the server 21 may store message data in a database 30, in other embodiments the server 21 stores message data in another data structure, such as log files.

What is claimed is:

1. A method of operating a fire protection system, the fire protection system comprising one or more fire protection components, the method comprising:

a fire protection component of the one or more fire protection components of the fire protection system generating a message indicating an event associated with the fire protection system;

determining a type of the message by determining whether the message is indicative of an Alarm, PreAlarm, PreWarning, Fault, Quiescent, Disabled, or Offline event;

determining that the message is indicative of a critical event when it is determined that the message is indicative of an Alarm, PreAlarm, or PreWarning event;

determining that the message is indicative of a non-critical event when it is determined that the message is indicative of a Fault, Quiescent, Disabled, or Offline event;

when it is determined that the message is indicative of a critical event, storing data associated with the message in a first collection of event data; and when it is determined that the message is indicative of a non-critical event, storing data associated with the message in a second different collection of event data.

2. The method of claim 1, where the fire protection component is a fire control panel, a fire detector, a smoke detector, a heat detector, a manual call point, a fire alarm, a fire suppression component, a sprinkler, a fire barrier, or a smoke extractor.

3. The method of claim 1, further comprising:

when it is determined that the message is indicative of a critical event, storing, in the second different collection of event data, a reference to the data associated with the message stored in the first collection of event data.

4. The method of claim 1, further comprising:

determining whether the message indicates that the state of the fire protection system has changed; and when it is determined that the message indicates that the state of the fire protection system has changed, updating information indicating the current state of the fire protection system.

5. The method of claim 4, further comprising:

making a copy of the information indicating the current state of the fire protection system at a first time; and then making a copy of the information indicating the current state of the fire protection system at a second different time.

6. The method of claim 5, further comprising:

reading a most recent copy of the information indicating the current state of the fire protection system and any message data stored since the most recent copy of the information indicating the current state of the fire protection system was made; and using the read information and message data to determine a current state of the fire protection system.

7. The method of claim 1, further comprising:

receiving a request to retrieve data associated with one or more messages;

determining whether all of the requested data is associated with messages indicative of critical events; and when it is determined that all of the requested data is associated with messages indicative of critical events, reading the requested data from the first collection of event data.

8. The method of claim 1, further comprising:

retaining and/or backing up data associated with messages indicative of critical events separately to data associated with messages indicative of non-critical events.

9. A fire protection system comprising:

one or more fire protection components, wherein one or more of the one or more fire protection components are configured to generate messages, each message indicating an event associated with the fire protection system;

storage for storing data associated with the fire protection system; and processing circuitry configured to:

determine whether a message generated by a fire protection component of the one or more fire protection components is indicative of an Alarm, PreAlarm, PreWarning, Fault, Quiescent, Disabled, or Offline event;

determine that the message is indicative of a critical event when it is determined that the message is indicative of an Alarm, PreAlarm, or PreWarning event;

determine that the message is indicative of a non-critical event when it is determined that the message is indicative of a Fault, Quiescent, Disabled, or Offline event;

when it is determined that the message is indicative of a critical event, store data associated with the message in a first collection of event data; and when it is determined that the message is indicative of a non-critical event, store data associated with the message in a second different collection of event data.

10. The system of claim 9, wherein the one or more fire protection components comprise one or more fire control panels, each fire control panel being connected to a respective set of one or more other fire protection components.

11. The system of claim 9, wherein the server is further configured to:

receive a request to retrieve data associated with one or more messages;

determine whether all of the requested data is associated with messages indicative of critical events; and when it is determined that all of the requested data is associated with messages indicative of critical events, read the requested data from the first collection of event data.

12. The system of claim 9, wherein:

the storage stores a database; and the first collection of event data is a first table in the database, and the second different collection of event data is a second different table in the database.

* * * * *